US009170593B2

(12) United States Patent
Capofreddi

(10) Patent No.: US 9,170,593 B2
(45) Date of Patent: Oct. 27, 2015

(54) VOLTAGE REGULATOR WITH IMPROVED LINE REJECTION

(71) Applicant: Fairchild Semiconductor Corporation, San Jose, CA (US)

(72) Inventor: Peter Capofreddi, Pine Grove Mills, PA (US)

(73) Assignee: Fairchild Semiconductor Corporation, San Jose, CA (US)

( * ) Notice: Subject to any disclaimer, the term of this patent is extended or adjusted under 35 U.S.C. 154(b) by 208 days.

(21) Appl. No.: 13/895,695

(22) Filed: May 16, 2013

(65) Prior Publication Data

US 2014/0340060 A1 Nov. 20, 2014

(51) Int. Cl.
*G05F 1/565* (2006.01)
*G05F 1/575* (2006.01)

(52) U.S. Cl.
CPC ..... *G05F 1/565* (2013.01); *G05F 1/575* (2013.01)

(58) Field of Classification Search
CPC ..... G05F 1/565; G05F 1/575; H02M 3/156
See application file for complete search history.

(56) References Cited

U.S. PATENT DOCUMENTS 5,939,867 A 8/1999 Capici et al.
6,265,856 B1 * 7/2001 Cali'et al. ..... 323/273
6,541,946 B1 4/2003 Chen et al.
6,700,361 B2 * 3/2004 Gregorius ..... 323/282
2011/0193540 A1 8/2011 Dasgupta

OTHER PUBLICATIONS

El-Nozahi et al., High PSR Low Drop-Out Regulator With Feed-Forward Ripple Cancellation Technique, IEEE Journal of Solid-State Circuits, Mar. 2010, 13 pages, vol. 45, No. 3.
Yang et al., A High-PSR LDO using a Feedforward Supply-Noise Cancellation Technique, IEEE, 978-1-4577-0223-5/11, 2011, 4 pages.

* cited by examiner

*Primary Examiner* — Fred E Finch, III
*Assistant Examiner* — Rafael O De Leon Domenech
(74) *Attorney, Agent, or Firm* — Grossman Tucker Perreault & Pfleger PLLC

(57) ABSTRACT

Devices and methods are provided for generating a regulated output voltage with improved line rejection based on an input voltage and a reference voltage. The device may include a pass transistor and a replica transistor, wherein source ports of the pass transistor and the replica transistor are coupled to the input voltage, a drain port of the pass transistor is coupled to the output voltage, and a gate port of the pass transistor is coupled to a gate port of the replica transistor. The device may further include a coupling circuit configured to couple current from the drain port of the replica transistor to the gate port of the replica transistor, the coupling circuit further configured to control voltage on the drain port of the replica transistor based on the reference voltage.

6 Claims, 5 Drawing Sheets

VOLTAGE REGULATOR WITH IMPROVED LINE REJECTION

FIELD

The present disclosure relates to voltage regulators, and more particularly, to voltage regulators with improved line rejection characteristics.

BACKGROUND

Voltage regulators generally convert an input, or supply voltage, to a controlled output voltage where the control is based on a reference voltage. While a constant output voltage is usually desired, in practice the output voltage of a conventional linear voltage regulator exhibits some fluctuation in response to variations on the supply line input voltage. Line rejection is the measure of the output fluctuation with respect to the variation in the input voltage. Current design trends for circuits that rely on regulated voltage are becoming increasingly intolerant of fluctuation and are requiring increased line rejection. Attempts to improve line rejection in conventional voltage regulators often require cascading two or more regulators, which results in increased component count, reduced efficiency and/or increased circuit complexity, all of which may be inappropriate for some applications.

BRIEF DESCRIPTION OF DRAWINGS

Features and advantages of the claimed subject matter will be apparent from the following detailed description of embodiments consistent therewith, which description should be considered with reference to the accompanying drawings, wherein:

Although the following Detailed Description will proceed with reference being made to illustrative embodiments, many alternatives, modifications, and variations thereof will be apparent to those skilled in the art.

DETAILED DESCRIPTION

Generally, the present disclosure provides devices and methods for voltage regulation with improved line rejection characteristics, such as, for example, an increased power supply rejection ratio (PSRR), while reducing component count, circuit complexity and cost. An output voltage of the regulator is generated based on an input (or supply line) voltage and a reference voltage. The regulator may include a plurality of transistors including a power output transistor and a replica transistor, as will be explained below. The output voltage may be regulated by a first feedback circuit which compares the output voltage to the reference voltage. The output voltage may be further regulated, to increase PSRR, by a second feedback circuit which controls the drain-source voltage of the replica transistor. The second feedback loop may be based on a comparison of a drain port voltage associated with the replica transistor to the output voltage or the reference voltage.

Figure 1:
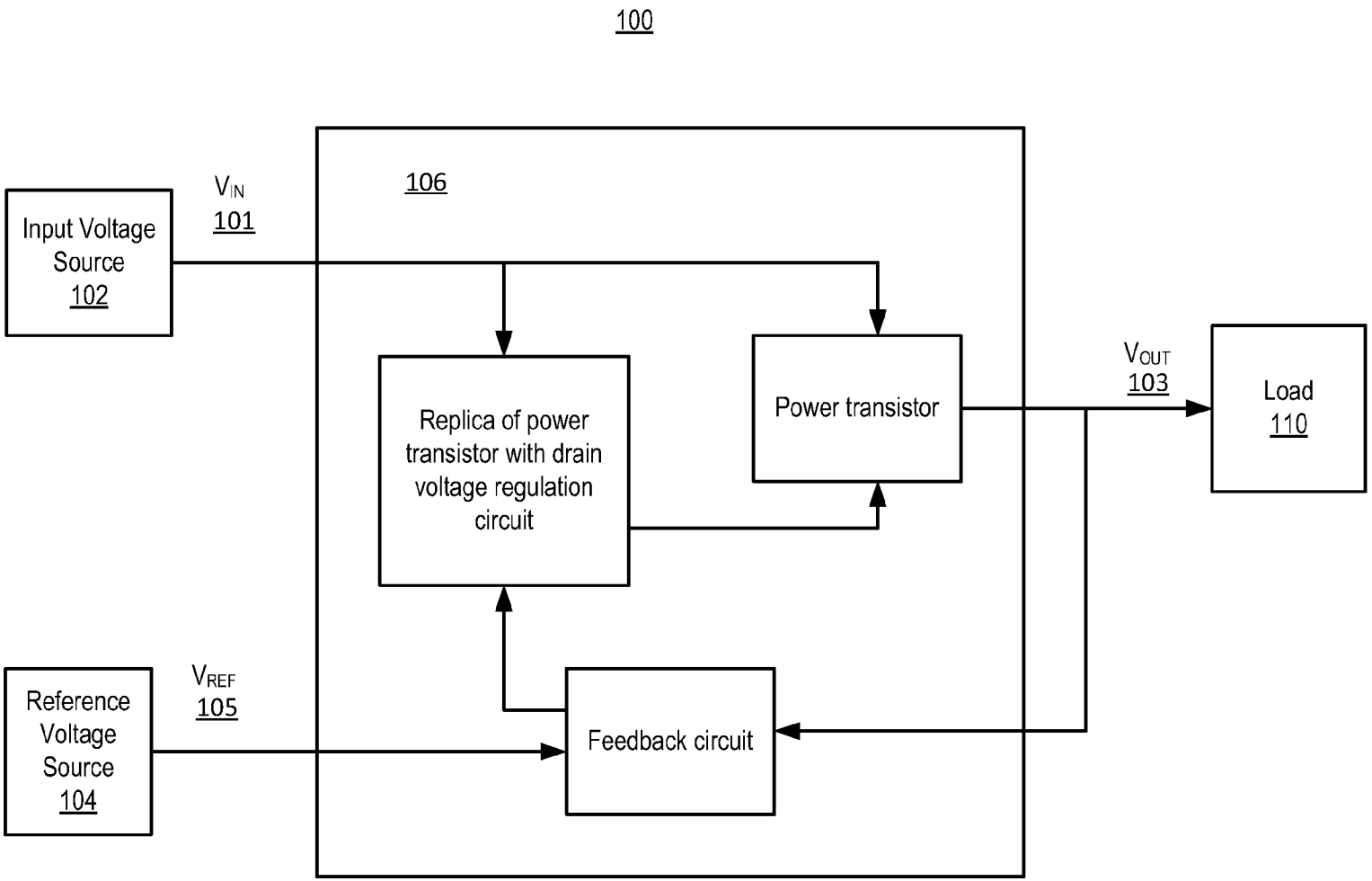
FIG. 1 illustrates a top level block diagram consistent with various embodiments of the present disclosure.

FIG. 1 illustrates a top level block diagram 100 consistent with various embodiments of the present disclosure. The system includes a voltage regulator circuit 106 with improved line rejection (increased PSRR). The voltage regulator circuit 106 is generally configured to receive an input voltage Vin 101 from an input voltage source such as, for example, a power supply voltage line. A reference voltage Vref 105 is also provided from a reference voltage source 104. The voltage regulator circuit 106 is further configured to generate a controlled output voltage Vout 103 which may be provided to a load 110. The output voltage 103 is controlled by the reference voltage 105, for example, the output voltage may match the reference voltage. The regulator 106 may include a number of transistors, for example a power (output) transistor and a replica transistor. The regulator 106 may also include a number of combinations of feedback paths as will be described in greater detail below, to control these transistors such that variations in the output voltage, generated in response to variations in the input voltage, are reduced. This may be accomplished by providing an improved replication of the power transistor by matching the drain-source voltage of the power transistor in the replica transistor.

In some embodiments, the voltage regulator may be included with, or form part of, a general-purpose or custom integrated circuit (IC) such as a semiconductor integrated circuit chip, system on chip (SoC), etc., and/or may be formed using discrete off-the-shelf and/or custom circuit components. Additionally, the transistors described in the following embodiments are metal oxide semiconductor (MOS) type devices, however, those skilled in the art will recognize that other transistor devices may be used, including bipolar junction transistors (BJTs), silicon carbide transistors (SiCs), insulated gate bipolar transistors (IGBT), etc.

Figure 2:
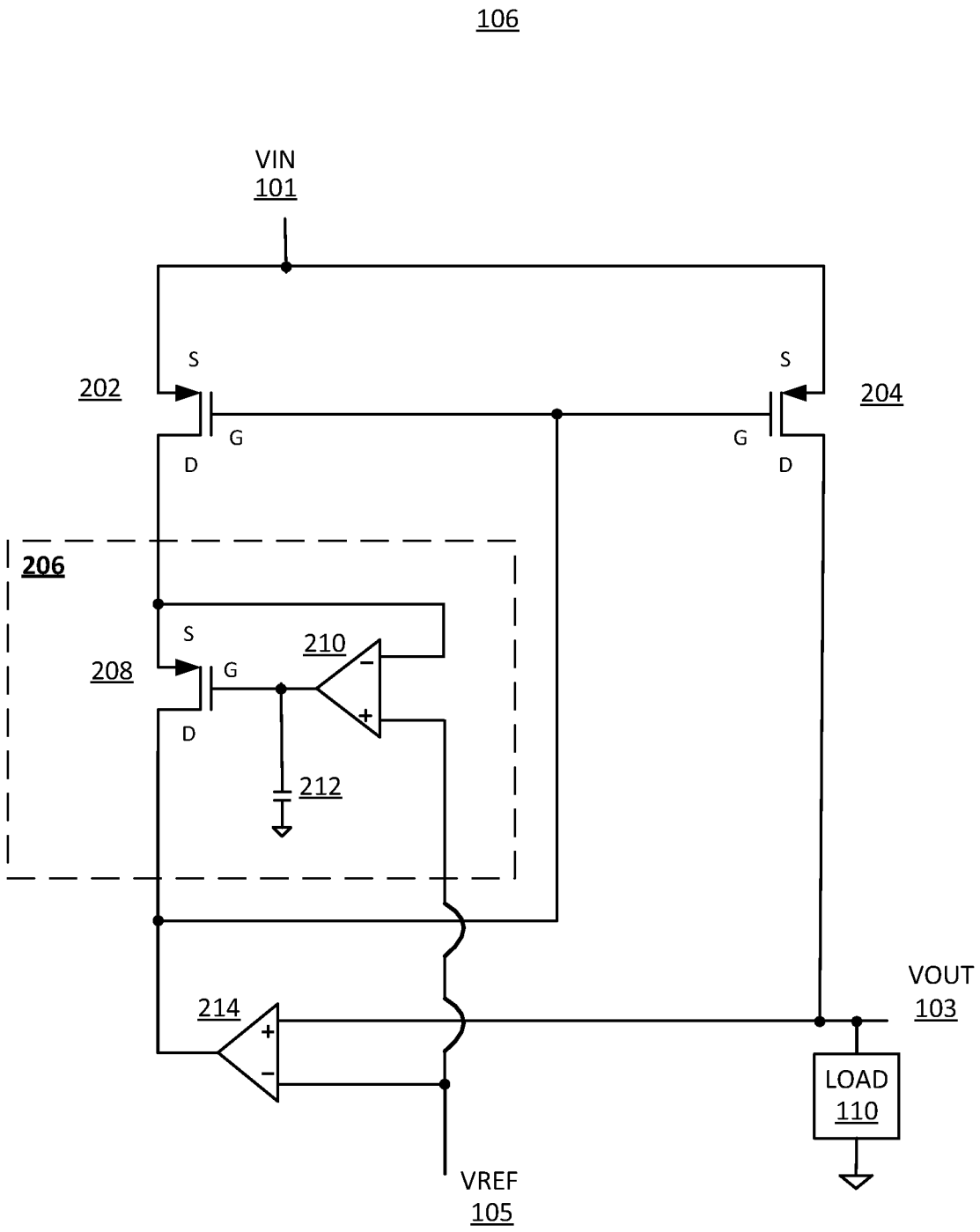
FIG. 2 illustrates a circuit diagram consistent with an exemplary embodiment of the present disclosure.

FIG. 2 illustrates a circuit diagram of voltage regulator circuit 106 consistent with an exemplary embodiment of the present disclosure. Voltage regulator circuit 106 includes transconductance amplifier 214 and output transistor 204 which are configured as a feedback circuit. This feedback circuit maintains the output voltage 103 of the regulator at a level that nominally matches, or is otherwise based on, the reference voltage 105. The feedback circuit may operate as follows. If output voltage 103 is higher than reference voltage 105, transconductance amplifier 214 produces a positive output current. This will increase the voltage at the gate of transistor 204, thereby decreasing its gate-source voltage. The decreased gate-source voltage will decrease the output current of the regulator 106 (i.e., the drain current of transistor 204). This will lower the output voltage 103 of the regulator 106. This feedback circuit may continue to operate until output voltage 103 of the regulator 106 matches the reference voltage 105.

A current mirror circuit, comprising output transistor 204 and a replica transistor 202, is configured to maintain the output current of the regulator (i.e., the drain current of transistor 204) at a multiple m times the drain current of transistor 202. The multiple m is determined by the ratio of the width of transistor 204 to the width of transistor 202.

A current coupling circuit 206 is configured to couple the drain current of transistor 202 to the drain of current coupling transistor 208 with a gain of one while simultaneously maintaining the drain-source voltage of transistor 202 at the same voltage as the drain-source voltage of output transistor 204, thereby improving the accuracy of the current mirror formed by transistors 202 and 204. The drain current of transistor 208 is summed with the output current of transconductance amplifier 214 and applied to the gate of transistors 202 and 204.

The current coupling circuit 206 may operate as follows. Transconductance amplifier 210 and transistor 208 form a second feedback loop. If the drain voltage of transistor 202 is higher than that of transistor 204, transconductance amplifier 210 produces a negative output current, which will decrease the voltage on the gate of transistor 208. With respect to the second feedback loop in current coupling circuit 206, transistor 208 operates as a source follower. The source voltage of transistor 208 will therefore also decrease. This feedback loop will continue to operate until the drain voltages of transistors 202 and 204 are nominally equal. If the drain voltage of transistor 202 is lower than that of transistor 204, the same sequence occurs with opposite polarities. Capacitor 212 may be employed in some cases to ensure the stability of this feedback loop formed by transconductance amplifier 210 and transistor 208. Capacitor 212, when present, lowers the frequency of the pole arising from parasitic capacitance at the gate of transistor 208 and thereby increases the phase margin of the feedback loop formed by transconductance amplifier 210 and transistor 208.

The current mirror circuit, formed by transistors 202 and 204, and the current coupling circuit 206 are configured to maintain the output current of the converter (i.e., the drain current of transistor 204) equal to m times the output current of transconductance amplifier 214. This ratio is maintained at a relatively constant level in the presence of variations in input voltage 101, thereby improving the line regulation (or PSRR) of the regulator 106. The current mirror circuit 202, 204, and the current coupling circuit 206 may operate as follows. When the input voltage 101 increases, the gate-source voltage of transistor 204 will increase, producing an undesired increase in output current. The gate-source voltage of transistor 202 matches that of transistor 204 and will therefore also increase, producing an increase in its drain current. With respect to the operation of the circuit formed by transistors 202 and 204 and current coupling circuit 206, transistor 208 is configured as a common-gate amplifier with a gain of one. The drain current of transistor 208 is equal to the drain current of transistor 202 and will therefore also increase. The increased drain current from transistor 208 is injected into the gates of transistors 202 and 204, so the gate voltage will rise, thereby decreasing the drain current of transistors 202 and 204. The output current of the regulator 106 will therefore decrease, correcting for the undesired increase produced by the increase in the input voltage 101. This feedback loop will continue to operate until the drain current of transistor 202 once again matches the output current of transconductance amplifier 214 and the output current of the regulator 106 (i.e., drain current of transistor 204) is equal to m times the output current of transconductance amplifier 214.

One disadvantage of the embodiment shown in FIG. 1 is that the drain-source voltage of transistor 208 needs to be maintained at a positive level. The drain-source voltage of transistor 208 is given approximately by:

$$V_{ds208}=V_{out}-V_{in}+V_T$$

where Vout is the output voltage 103 of the regulator 106, Vin is the input voltage 101 of the regulator 106, and $V_T$ is the threshold voltage of transistor 208, typically about 0.7 volts. In this embodiment, therefore, Vin and Vout should differ by less than about 700 millivolts. This issue is overcome by the embodiment described in connection with FIG. 3, below.

Figure 3:
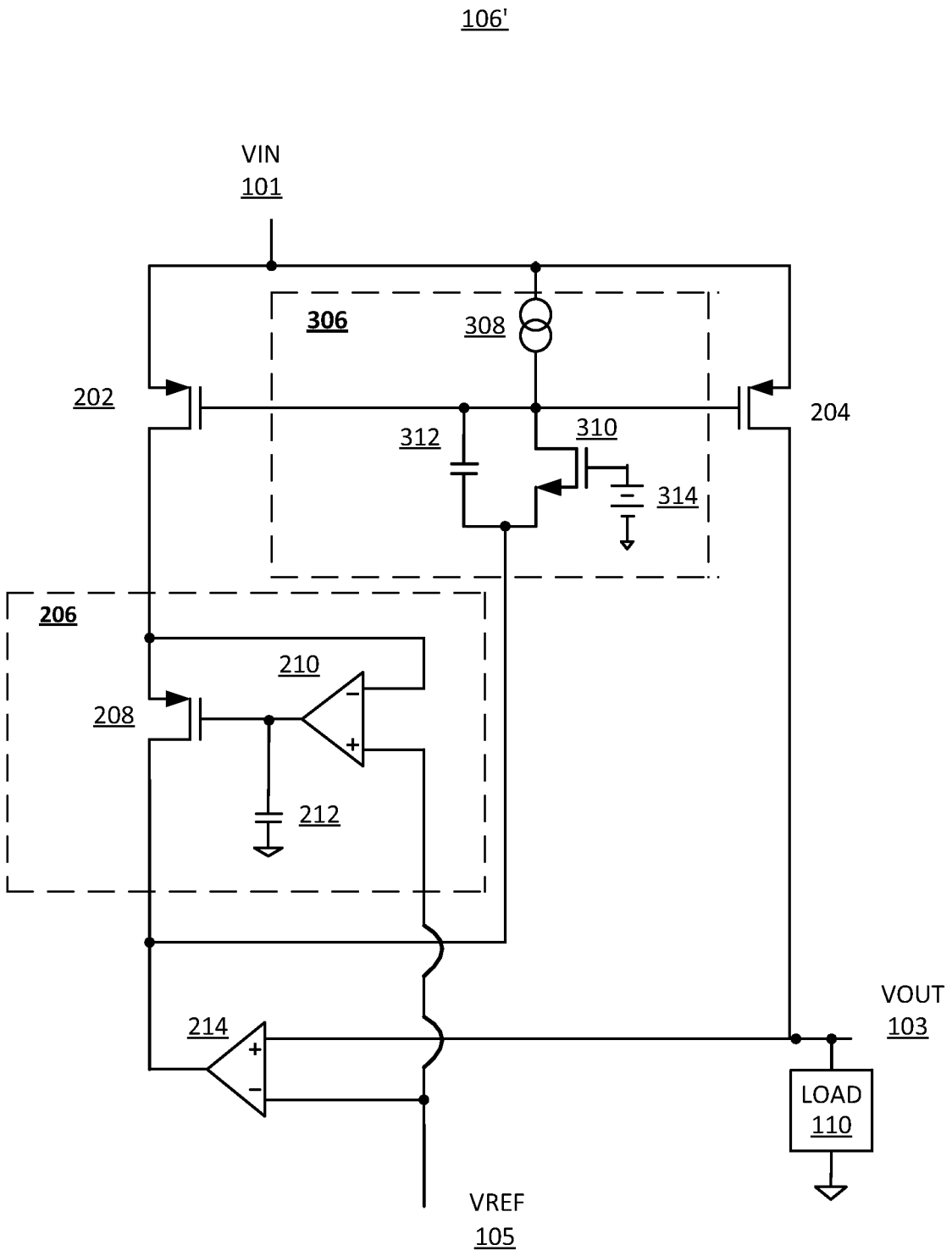
FIG. 3 illustrates a circuit diagram consistent with another exemplary embodiment of the present disclosure.

FIG. 3 illustrates a circuit diagram of voltage regulator circuit 106' consistent with another exemplary embodiment of the present disclosure. In this embodiment, transistors 202 and 204 again form a current mirror whose purpose is to maintain the output current of the regulator 106' (the drain current of transistor 204) at a multiple m times the drain current of transistor 202. The multiple m is determined by the ratio of the width of transistor 204 to the width of transistor 202.

The current coupling circuit 206 is configured to couple the drain current of transistor 202 to the drain of transistor 208 with a gain of one while simultaneously maintaining the drain-source voltage of transistor 202 at the same voltage as the drain-source voltage of output transistor 204, thereby improving the accuracy of the current mirror formed by transistors 202 and 204, in the same manner described with reference to FIG. 1.

An additional current coupling circuit 306 is configured to couple the sum of the drain current of transistor 208 and the output current of transconductance amplifier 214 to the gates of transistors 202 and 204 with a gain of one, while simultaneously maintaining the voltage at the source of transistor 310 at a constant voltage.

The drain current of transistor 202 is equal to $$I_{DS202}=I_{214}-I_{308}$$

where $I_{214}$ represents the output current of transconductance amplifier 214 and $I_{308}$ represents current provided by a fixed current source 308.

The output current of the regulator 106' is therefore $$I_{DS204}=m(I_{213}-I_{308})$$

The circuit formed by transistors 202 and 204 and current coupling circuits 206 and 306 may operate as follows. As the input voltage 101 increases, the gate-source voltage of transistor 204 will increase, producing an undesired increase in output current. The gate-source voltage of transistor 202 is nominally equal to the gate-source voltage of transistor 204 and will therefore also increase, producing an increase in its drain current. With respect to the operation of the circuit formed by transistors 202 and 204 and current coupling circuits 206 and 306, transistor 208 is configured as a common-gate amplifier. Its drain current is equal to the drain current of transistor 202 and will therefore also increase. The increased drain current from transistor 208 will subtract from the output current of transconductance amplifier 214, thereby decreasing the current at the source of transistor 310. With respect to the operation of the circuit formed by transistors 202 and 204 and current coupling circuits 206 and 306, transistor 310 is configured as a common-gate amplifier, and its drain current is therefore nominally equal to its source current. The drain current of transistor 310 is subtracted from the fixed current source 308. The net current injected into the gates of transistors 202 and 204 will therefore increase, and the gate voltage will rise, thereby decreasing the drain current of transistors 202 and 204. The output current of the regulator 106' will therefore decrease, correcting for the undesired increase produced by the increase in input voltage 101. This feedback loop will continue to operate until the drain current of transistor 202 once again matches $I_{214}-I_{308}$, and the output current of the regulator 106' (drain current of transistor 204) is approximates $m(I_{214}-I_{308})$. When the input voltage 101 decreases, the same sequence occurs with opposite polarities.

Bypass capacitor 312 provides a high-frequency bypass path for common-gate configured transistor 310. Transistor 310 is configured to couple the sum of output current of transconductance amplifier 214 and the drain current of transistor 208 to the gate of transistors 202 and 204 with a gain of one at lower frequencies. Bypass capacitor 312 is configured to couple the sum of output current of transconductance amplifier 214 and the drain current of transistor 310 to the gate of transistors 202 and 204 with a gain of one at higher frequencies. Bypass capacitor 312 permits the fixed current source 308, which provides the bias for the common-gate configured transistor 310, to be smaller than would be required without the capacitor. In one embodiment, fixed current source 308 is approximately 10 microamps.

Figure 4:
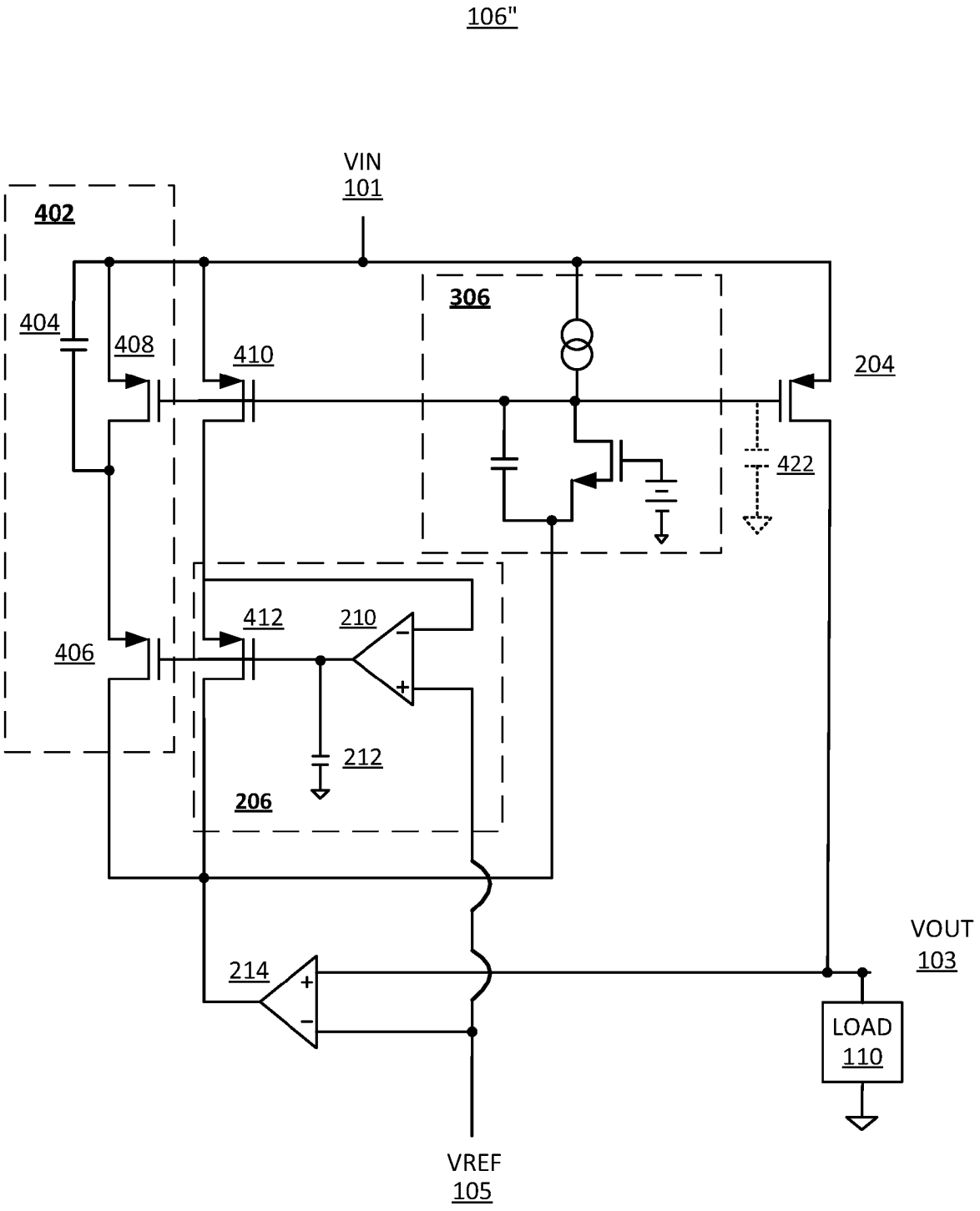
FIG. 4 illustrates a circuit diagram consistent with another exemplary embodiment of the present disclosure.

FIG. 4 illustrates a circuit diagram of voltage regulator circuit 106" consistent with another exemplary embodiment of the present disclosure. In this embodiment, the current mirror transistor 202 has been subdivided into two transistors 408 and 410, while common-gate amplifier configured transistor 208 has been subdivided into two transistors 406 and 412. In one embodiment, the widths of transistors 408 and 410 are equal, and equal to half of the width of transistor 202, while the widths of transistors 406 and 412 are equal, and equal to half of the width of transistor 208. In this embodiment, the source voltage of transistor 412 is the same as the source voltage of transistor 406, and the subdivision of transistors 202 and 208 has no effect on the operation of the circuit. In the absence of capacitor 404, the embodiment of FIG. 4 operates in the same manner as the embodiment of FIG. 3.

Capacitor 404 provides a high frequency bypass path which improves the power supply rejection ratio of the regulator 106" at high frequencies.

When the input voltage 101 increases, the gate-source voltage of transistor 204 will increase, thereby producing an undesired increase in output current. In a manner similar to the operation of the circuit in FIG. 3, the feedback loop, formed by transistors 408 and 410 and current coupling circuits 206 and 306, will increase the voltage on the gate of transistor 204 and thereby correct the undesired increase in output current. Any embodiment of the system will include undesired parasitic capacitance 422 between the gate voltage of transistors 408, 410 and 204 and ground, however. The current provided by current coupling circuit 306 must charge parasitic capacitor 422 before the output current is restored to its correct value. This problem is ameliorated by the introduction of capacitor 404.

When the input voltage 101 increases by a voltage capacitor 404 injects a charge $C_{404}$ times $\Delta V_{in}$ into the source of transistor 406. Since transistor 406 is configured as a common-gate amplifier, this charge is passed to the drain of transistor 406 with a gain of one. Current coupling circuit 306 then passes the charge to the gates of transistors 410 and 204 with a gain of one. This charge charges undesired parasitic capacitance 422, which increases the gate voltage by a voltage $$\Delta V_{gate} = \Delta V_{in} \frac{C_{404}}{C_{422}}$$

In one embodiment, the value of capacitor 404 is chosen to be equal to an estimate of undesired parasitic capacitance 422. Parasitic capacitance 422 can be estimated from post-layout parasitic capacitance extraction tools or by any other suitable mechanism. Under this condition, $\Delta V_{gate}=\Delta V_{in}$ so that the change in the input voltage 101 produces the same voltage change in the gate voltage of transistors 408, 410 and 204. This maintains a constant gate-source voltage on output transistor 204 and therefore a constant output current from the regulator 106".

Figure 5:
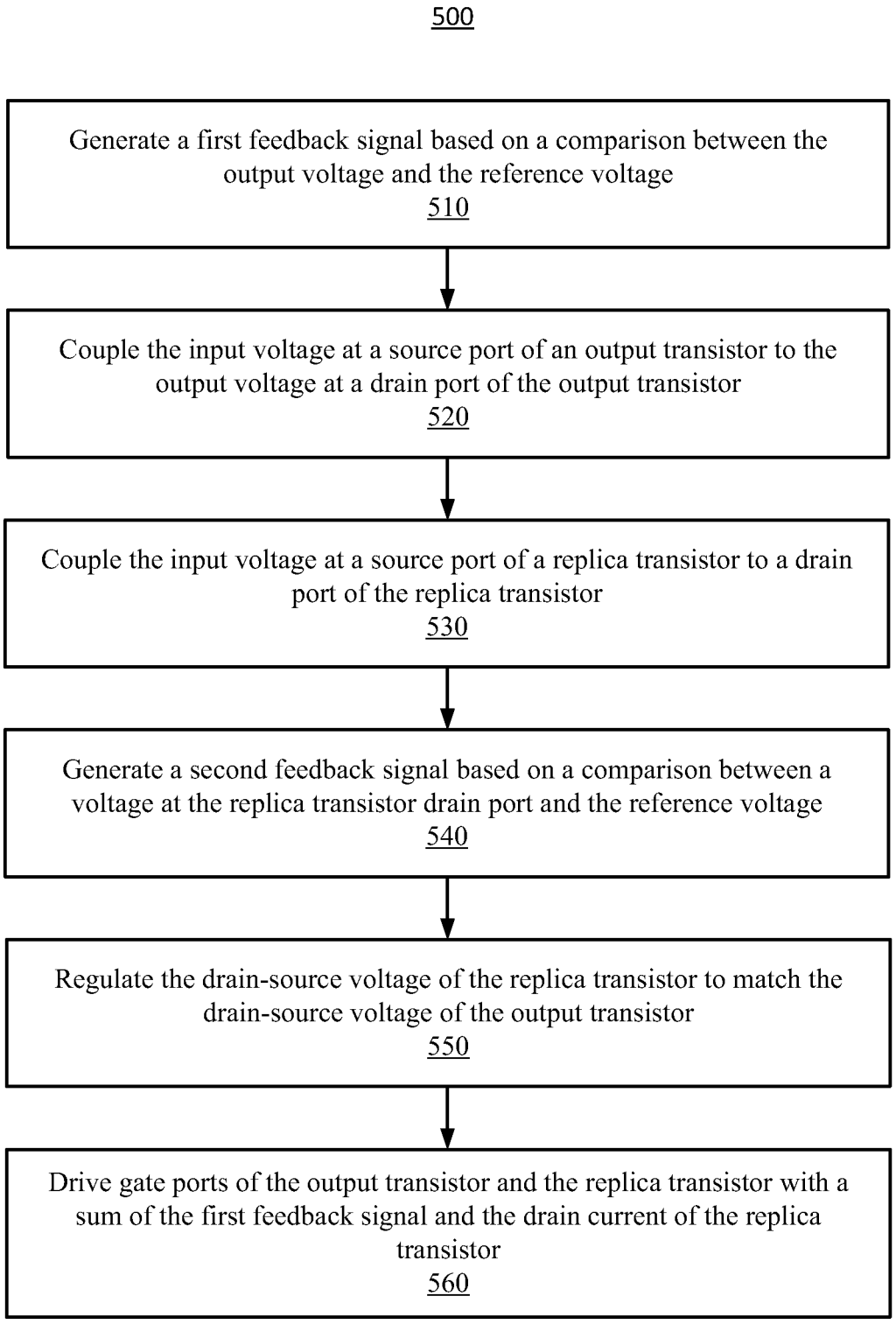
FIG. 5 illustrates a flowchart of operations consistent with various embodiments of the present disclosure.

FIG. 5 illustrates a flowchart of operations 500 consistent with various embodiments of the present disclosure for voltage regulation of an output voltage, based on an input voltage and a reference voltage, with improved line rejection. At operation 510, a first feedback signal is generated based on a comparison between the output voltage and the reference voltage. At operation 520, the input voltage at a source port of an output transistor is coupled to the output voltage at a drain port of the output transistor. At operation 530, the input voltage at a source port of a replica transistor is coupled to a drain port of the replica transistor. At operation 540, a second feedback signal is generated based on a comparison between a voltage at the replica transistor drain port and the reference voltage. At operation 550, the drain-source voltage of the replica transistor is regulated to match the drain-source voltage of the output transistor. At operation 560, gate ports of the output transistor and the replica transistor are driven with a sum of the first feedback signal and the drain current of the replica transistor.

While the figures of the present disclosure illustrate embodiments that include circuitry described in a preceding embodiment, it is to be understood that any of the proposed embodiments may be utilized individually or combined. Indeed, it is fully contemplated herein that in other embodiments of the present disclosure, the functionality described elsewhere herein may be combined in a manner not specifically shown in any of the drawings, but still fully consistent with the present disclosure. Thus, claims directed to features and/or operations that are not exactly shown in one drawing are deemed within the scope and content of the present disclosure. In addition, "circuitry" or "circuit", as used in any embodiment herein, may include, for example, singly or in any combination, hardwired circuitry, programmable circuitry, state machine circuitry, and/or circuitry available in a larger system, for example, discrete elements that may be included as part of an integrated circuit. In addition, any of the transistor devices described herein may include any type of known or after-developed transistor or switch circuitry such as, for example, MOS transistors, BJTs, SiC transistors, etc. The term "transistors" may be embodied as MOSFET transistors (e.g. individual NMOS and PMOS elements), BJT transistors and/or other switching circuits known or to be developed in the art.

Embodiments of the methods described herein may be implemented in a system that includes one or more storage mediums having stored thereon, individually or in combination, instructions that when executed by one or more processors perform the methods. Here, the processor may include, for example, a system CPU (e.g., core processor) and/or programmable circuitry. Thus, it is intended that operations according to the methods described herein may be distributed across a plurality of physical devices, such as processing structures at several different physical locations. Also, it is intended that the method operations may be performed individually or in a subcombination, as would be understood by one skilled in the art. Thus, not all of the operations of each of the flow charts need to be performed, and the present disclosure expressly intends that all subcombinations of such operations are enabled as would be understood by one of ordinary skill in the art.

The storage medium may include any type of tangible medium, for example, any type of disk including floppy disks, optical disks, compact disk read-only memories (CD-ROMs), compact disk rewritables (CD-RWs), digital versatile disks (DVDs) and magneto-optical disks, semiconductor devices such as read-only memories (ROMs), random access memories (RAMs) such as dynamic and static RAMs, erasable programmable read-only memories (EPROMs), electrically erasable programmable read-only memories (EEPROMs), flash memories, magnetic or optical cards, or any type of media suitable for storing electronic instructions.

As used herein, use of the term "nominal" or "nominally" when referring to an amount means a designated or theoretical amount that may vary from the actual amount.

Thus, the present disclosure provides devices and methods for voltage regulation with improved line rejection characteristics. According to one aspect there is provided a voltage regulator device. The device may include a feedback circuit configured to generate a first feedback signal based on a comparison between the output voltage and the reference voltage. The device of this example may also include an output transistor including a source port, a gate port and a drain port, the output transistor configured to couple the input voltage at the output transistor source port to the output voltage at the output transistor drain port. The device of this example may further include a replica transistor including a source port, a gate port and a drain port, the replica transistor configured to couple the input voltage at the replica transistor source port to the replica transistor drain port. The device of this example may further include and a current coupling circuit configured to regulate the drain voltage of the replica transistor.

According to another aspect there is provided a method. The method may include generating a first feedback signal based on a comparison between the output voltage and the reference voltage. The method of this example may also include coupling the input voltage at a source port of an output transistor to the output voltage at a drain port of the output transistor. The method of this example may further include coupling the input voltage at a source port of a replica transistor to a drain port of the replica transistor. The method of this example may further include generating a second feedback signal based on a comparison between a voltage at the replica transistor drain port and the reference voltage. The method of this example may further include regulating a drain-source voltage of the replica transistor to match a drain-source voltage of the output transistor. The method of this example may further include driving a gate port of the output transistor and a gate port of the replica transistor with a sum of the first feedback signal and a current from the drain port of the replica transistor.

According to one aspect there is provided a voltage regulator device. The device may include a pass transistor and a replica transistor. Source ports of the pass transistor and the replica transistor are coupled to the input voltage, a drain port of the pass transistor is coupled to the output voltage, and a gate port of the pass transistor is coupled to a gate port of the replica transistor. The device of this example may also include a coupling circuit configured to couple current from the drain port of the replica transistor to the gate port of the replica transistor, the coupling circuit further configured to control voltage on the drain port of the replica transistor based on the reference voltage.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents. Various features, aspects, and embodiments have been described herein. The features, aspects, and embodiments are susceptible to combination with one another as well as to variation and modification, as will be understood by those having skill in the art. The present disclosure should, therefore, be considered to encompass such combinations, variations, and modifications.

What is claimed is:

1. A voltage regulator device for generating an output voltage based on an input voltage and a reference voltage, said device comprising:

a pass transistor, a first replica transistor and a second replica transistor, wherein source ports of said pass transistor and said first and second replica transistors are coupled to said input voltage, a drain port of said pass transistor is coupled to said output voltage, and a gate port of said pass transistor is coupled to gate ports of said first and second replica transistors;

a capacitor coupled to said input voltage and a drain port of said second replica transistor;

a coupling circuit configured to couple current from a drain port of at least said first replica transistor to said gate ports of said first and second replica transistors, said coupling circuit further configured to control voltage on at least said drain port of said first replica transistor based on at least said reference voltage.

2. The device of claim 1 wherein said coupling circuit further comprises a first current coupling transistor and a second current coupling transistor, wherein a source port of said first current coupling transistor is coupled to said drain port of said first replica transistor and a source port of said second current coupling transistor is coupled to said drain port of said second replica transistor.

3. The device of claim 1 wherein said coupling circuit further comprises an operational amplifier comprising:

a first input coupled to said drain port of said first replica transistor;

a second input coupled to said reference voltage; and an output terminal coupled to gate ports of said first and second current coupling transistors.

4. The device of claim 1, wherein current through said pass transistor is proportional to current through said replica transistor.

5. The device of claim 1, wherein said pass transistor and said first and second replica transistors are configured as PMOS transistors.

6. The device of claim 1, further comprising a second coupling circuit configured to receive said current from said drain port of at least said first replica transistor via said coupling circuit to provide said current to said first and second replica transistor gate ports with a unity gain factor.

* * * * *